United States Patent [19]

Grüter et al.

[11] 4,295,046

[45] Oct. 13, 1981

[54] MASS SPECTROMETER

[75] Inventors: Karl Grüter, Brauweiler; Jürgen Leineweber, Cologne, both of Fed. Rep. of Germany

[73] Assignee: Leybold Heraeus GmbH, Cologne, Fed. Rep. of Germany

[21] Appl. No.: 940,829

[22] Filed: Sep. 8, 1978

Related U.S. Application Data

[63] Continuation of Ser. No. 722,415, Sep. 13, 1976, abandoned.

[30] Foreign Application Priority Data

Sep. 11, 1975 [DE] Fed. Rep. of Germany ..... 2540505

[51] Int. Cl.[3] ..... B01D 59/44; H01J 49/00

[52] U.S. Cl. ..... 250/287; 250/423 P

[58] Field of Search ..... 250/281, 282, 283, 287, 250/288, 397, 423 R, 423 P

[56] References Cited

U.S. PATENT DOCUMENTS

| | | | |
|---|---|---|---|
| 2,758,214 | 8/1956 | Glenn | 250/287 |
| 2,957,985 | 10/1960 | Brubaker | 250/287 |
| 3,294,970 | 12/1966 | Jenckel | 250/423 R |
| 3,406,349 | 10/1968 | Swain et al. | 250/423 P |
| 3,634,683 | 1/1972 | Bakker | 250/287 |
| 3,644,731 | 2/1972 | Eloy | 250/288 |

*Primary Examiner*—Bruce C. Anderson

*Attorney, Agent, or Firm*—Spencer & Kaye

[57] ABSTRACT

A transit time mass spectrometer for analyzing ions having different energies, particularly ions emitted under the influence of radiation, especially laser radiation. The mass spectrometer is provided with a device forming a drift path having input and output ends and adapted to be traversed by the ions in a predetermined direction, with an ion detector which is located downstream of the output end of the drift path, and with a lens arrangement, as, for example, as electrostatic or magnetic lens system for focussing as well as for accelerating the ions. The lens system has at least two sections at least one of which is upstream of the input end.

6 Claims, 5 Drawing Figures

PRIOR ART STRUCTURE

MASS SPECTROMETER

CROSS REFERENCE TO RELATED APPLICATION

This application is a continuation of application Ser. No. 722,415, filed Sept. 13th, 1976 abandoned.

BACKGROUND OF THE INVENTION

The present invention relates to a transit time or so-called time-of-flight mass spectrometer (TOFMS) for analyzing ions having different energies, particularly ions emitted under the influence of radiation, especially laser radiation, which mass spectrometer is of the type having a device forming a drift path as well as an ion detector located at the output or downstream end of the drift path for analyzing the ions.

Transit time mass spectrometry is used for analyzing various elements and isotopes with respect to their mass to charge ratio. The specimen to be analyzed is subjected to stimulation such as laser radiation, ion radiation, electron radiation, or any other forms of energy application which causes the specimen to emit ions. These ions are accelerated in an electric field and are directed toward a drift path whose downstream output end leads to an ion detector or analyzer. Different ions are accelerated to different velocites, depending or their mass to charge ratio, and, after having travelled through the drift path at a constant velocity, reach the ion detector at different times. A brief start pulse, the duration of which must be smaller than the time interval between two consecutive masses, is obtained either by pulsed excitation or by a brief deflection of the beam in an electric or magnetic field.

The electrostatic lens system of a mass spectrometer of the above type is conventionally constituted by a unitary lens. The use of such a lens, however, makes it necessary to provide a suction field for drawing the ions in the direction of the lens, this normally being brought about with the help of a grid which is located in front of the specimen and which has the acceleration potential applied it. Such an arrangement has the drawback that the grid greatly attenuates the transmission, i.e., the ion flow, the reason for this being that the solid portions forming the meshes of the grid have finite widths. Still another drawback of such an arrangement is that even small deformations of the grid will cause aberrations or image distortions.

A mass spectrometer of the above general type is described in *The Review of Scientific Instruments,* Volume 37, No. 7, 196, pages 938 ff, which deals with a mass spectrometer for detecting the ions emitted as the result of being subjected to laser radiation. However, the mass spectrometer there described does not suggest the provision of a lens arranged ahead of the drift path so that the ions cannot be analyzed on the basis of their energy levels.

It is, therefore, one of the primary objects of the present invention to provide a transit time mass spectrometer of the above-discussed general type but which avoids the mentioned drawbacks.

Other objects to be accomplished by the present invention will be set forth below.

SUMMARY OF THE INVENTION

With the above object and the other objects to be set forth below in view, the present invention resides, basically, in a transit time mass spectrometer for analyzing ions having different energies, particularly ions which are emitted under the influence of radiation, especially laser radiation. The mass spectrometer is provided with means forming a drift path which is adapted to be traversed by the ions in a predetermined direction. The upstream end of the drift path is the input end and the downstream end is the output end. An ion detector is located downstream of the output end of the drift path and lens means are provided which include a cylinder lens having at least two sections. The lens system serves to focus as well as to accelerate the ions, and at least one section is arranged upstream of the input end.

DETAILED DESCRIPTION OF THE PREFERRED EMBODIMENTS

Figure 1:
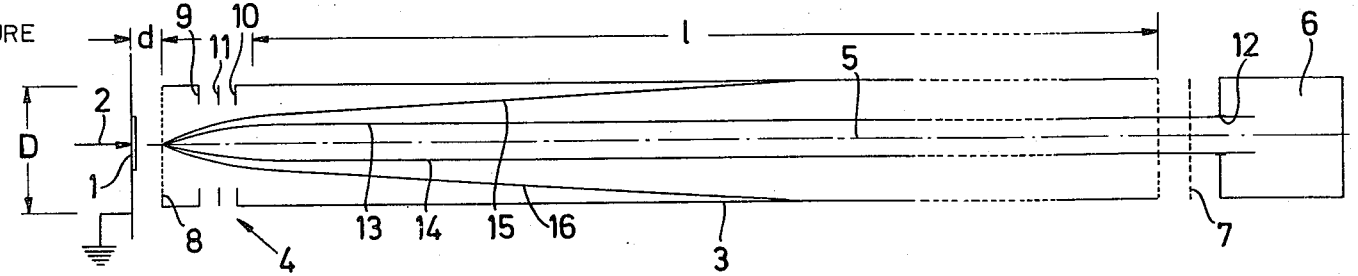
FIG. 1 is a diagrammatic sectional view of a mass spectrometer having the general structure of a mass spectrometer according to the prior art.

As already stated above, a transit time mass spectrometer according to the present invention incorporates a cylinder lens having two or more sections, each constituting a terminal or pole, which cylinder lens eliminates the need for the heretofore conventional grid electrode which is able only to accelerate the ions but not to focus the ion beam. Consequently, image defects or aberrations as well as transmission losses are reduced or avoided, and this, in turn, increases the precision with which the measurement can be carried out. Their representation or image reproducing characteristics of the lens can be varied by changing the lens diameter and/or by changing the acceleration potential. The lens diameter V is determined by the ratio of the length of the first section of the multiple sectional lens to the diameter of this first section. In practice, the diameter of the lens should not be too large so that time distortions, which depend on the length of the acceleration path, will likewise not be too great. It will be appreciated that the greater the time distortion, i.e., the less precise the transit time of the ions, the less will be the accuracy with which the starting point of the transit time can be determined.

It will, moreover, be understood that the practicability of transit time mass spectrometry is limited by the existing initial energy distribution of the ions, which itself depends on the manner in which the ions are stimulated. This, in turn, means that transit time differences for a given type of isotope can, due to the different initial energies, be greater than transit time differences with respect to consecutive masses. This is particularly true, at least insofar as it has been possible to determine this to date, in the case of laser stimulated specimens, i.e., the energy distribution among laser stimulated ions can be particularly great; in fact, it has been found from the measurement of the energy distribution of ions produced as the result of a laser radiation produced plasma, that the initial energies can be of the order of several hundred eV. In view of this, it has, in accordance with the present invention, been found advantageous to equip the mass spectrometer with a lens system which focusses onto the entrance opening of the ion detector only those ions which have a predetermined energy interval lying in the region of the maximum energy distribution. This is achieved by appropriately configuring the lens system and/or by connecting the lens system to an appropriate supply or bias voltage. In practice, the object is achieved by making use of the chromatic aberration of an electrostatic lens system, because nearly all of the ions of the desired energy interval can then be made to flow from the plasma to the detector, whereas only a small fraction of the ions having a higher or lower energy—specifically, only those which are emitted within a narrow aperture angle whose center is at 0°—will strike the entrance opening of the detector. The transit time mass spectrometer according to the present invention can therefore reach a transmission factor of nearly 1.

The following factors are relevant in determining the width of the mentioned energy interval in the case of a transit time mass spectrometer having the desired resolution.

The transit time of the ions, calculated from the instant at which the ions start their travel until they impinge on the detector, is composed of the components $t_d$ and $t_l$, the former being the time it takes for the ions to move through the acceleration path where the velocity of the ions is increased, and the latter being the time it takes for the ions to move, at constant velocity, through the drift path. This relation is expressed mathematically as follows:

$$t = t_d + t_l \tag{1}$$

where $$t_l = 7.195 \cdot 10^{-5} \sqrt{\frac{M}{U + E_o}} \cdot l[\text{sec}] \tag{2}$$

with M being the mass of the atom expressed in atomic mass units, U being the potential of the drift path in V, $E_o$ being the initial energy in electron volts, and l being the length of the drift path in millimeters.

If the ions travel along the path d while being subjected to a constant acceleration under the influence of a field having a strength F=U/d, the acceleration time $t_d$ will be $$t_d = 1.439 \cdot 10^{-4} \left\{ 1 + \frac{E_O}{lU} - \sqrt{\frac{E_O}{lU}} \right\} \sqrt{\frac{M}{U}} \cdot d \tag{3}$$

where d is the length of the acceleration path in millimeters and e is the elementary charge (charge of an electron).

There is thus obtained for each mass a time interval which has been expanded in accordance with the initial energy distribution of the ions $$\Delta t(\Delta E)_M = \Delta t_d \cdot (\Delta E)_M + \Delta t_l \cdot (\Delta E)_M$$

which is composed of the two components $\Delta t_d$ and $\Delta t_l$; these, as per equations (2) and (3), correspond to the time differences for the different initial energies encountered along the acceleration path d and along the drift path l.

In order to allow two consecutive masses to be separated in the transit time spectrum, the following condition must be met:

$$[t_M - t_{M-1}] - \Delta t(\text{detector electronic}) \geqq \Delta t(\Delta E)_M \tag{4}$$

According to a further feature of the present invention, the lens system is in the form of a three-section or three-terminal cylindrical lens. The characteristics of this lens can, for example, be such that the ions are accelerated by means of a high potential in the first section and are then retarded to a drift potential of, for example, 3 KV. If the total energy is large, the effect of different initial energies will be relatively little, so that with the help of such an arrangement, there will be a small time difference in the acceleration path for ions of the same mass but of different initial energy.

The effect which the acceleration path has on the time distortion can, in accordance with the present invention, be further reduced by making the diameter of that section of the three-terminal cylinder lens which brings about the acceleration of the ions smaller than, and preferably less than half of, the diameter of the remaining sections.

In accordance with a further feature of the present invention, another way of reducing the time distortion is to provide an aperture diaphragm between the ion-emitting specimen to be analyzed and the cylinder lens. The aperture diaphragm is placed at the same potential as that section of the cylinder lens which is furthest upstream and thus closest to the specimen, and has an aperture which is as small as possible without impairing the ion flow.

According to yet another feature of the present invention, a retarding grid is arranged between the output end of the drift path and the ion detector. The function of the grid is to prevent low-energy ions which are scattered against the tubular walls of the drift path from reaching the detector.

Referring now to the drawings, FIG. 1, as mentioned above, illustrates the general structure of a transit time mass spectrometer in accordance with the prior art, while FIGS. 2 to 5 show four embodiments of a mass spectrometer in accordance with the present invention. The drawings are not to scale, and part of the length of the means forming the drift path in each embodiment is shown by dashed lines. Throughout all of the figures, similar or analogous parts are designated by the same reference numerals.

FIG. 1 shows a mass spectrometer for analyzing ions emitted by a test specimen 1 which is stimulated by a suitable form of energy, such as a laser beam shown schematically at 2. The means for producing the laser radiation or other form of energy are not shown inasmuch as they are conventional and do not form a part of the present invention.

The mass spectrometer comprises means 3 forming a drift path adapted to be traversed by the ions in a predetermined direction, this being from left to right as viewed in the FIG. 1 so that the left-hand end is the upstream or input end of the drift path while the right-hand end is the downstream or output end. An electrostatic lens system 4 is arranged upstream of the input end and is aligned on an axis 5 which is common to the lens system and the drift path. An ion detector 6, which may, for example, be constituted by a secondary electron multiplier, is arranged downstream of the output end, there being a retarding grid 7 arranged between the output end of the drift path and the ion detector 6, this retarding grid serving to prevent low-energy ions which are scattered against the tubular wall of the means 3 forming the drift path from reaching the detector 6.

As stated above, the mass spectrometer is illustrative of the general structure of the prior art and, accordingly, the lens system is constituted by a unitary lens, there additionally being provided a grid 8 which lies, for example, at a potential of −3 KV. The grid 8 creates a suction field for drawing the ions emitted by the specimen in the direction of the lens 4 and drift path 3. The distance between the grid 8 and the specimen is shown at d and is, for example, 4 mm. The unitary lens has two outer electrodes 9 and 10 and a middle electrode 11, each of the two outer electrodes being at a potential of −3 KV and the middle electrode being at a potential of +1 KV. If the diameter D of the unitary electrode is 20 mm, the length l of the drift path is 1000 mm, and the diameter of the entrance opening 12 of the detector 6 is about 10 mm, the characteristics of an embodiment possessing these parameters are such that only those ions which have energy interval of 1 to 15 eV will be reproduced on the entrance opening of the detector. Two trajectories followed by ions having this energy interval are shown at 13 and 14. If the energy of the ions is greater, they will not be projected onto the entrance opening of the detector 6, but are lost on the wall of the tube forming the drift path 3. Two exemplary trajectories of such ions are shown at 15 and 16.

Figure 2:
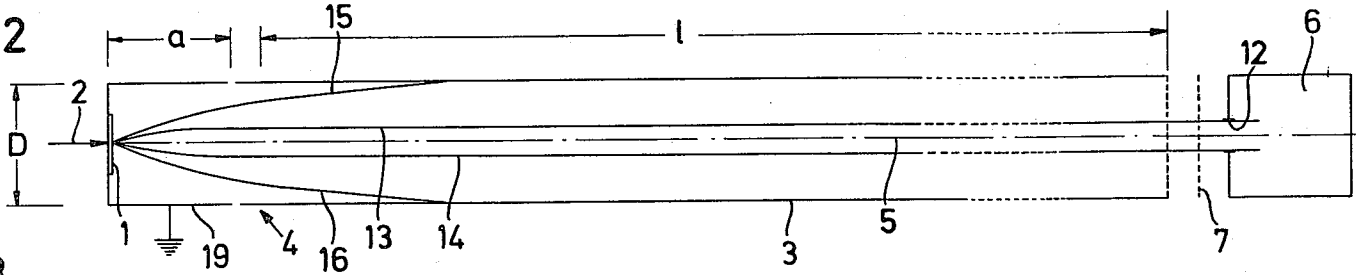
FIG. 2 is a diagrammatic sectional view of one embodiment of a mass spectrometer according to the present invention.

Referring now to FIG. 2, the same shows a mass spectrometer in accordance with the present invention, and it differs from the mass spectrometer of FIG. 1 in that it incorporates a lens system constituted by a multiple section—in this case a two-section or two-pole—cylinder lens. The advantage of this arrangement over that shown in FIG. 1 is that the lens system of FIG. 2 serves both to focus the ion beam in accordance with the present invention and to accelerate the ions. To accomplish this, the test specimen 1 is arranged in the origin of the first cylinder section 19, this being the electrode which is furthest upstream of the input end of the drift path. The second cylinder section encompasses the drift path and is, in the interests of simplicity, identified by reference numeral 3 which also shows the means forming the drift path. In order to project ions having an energy interval of, for example, 1 to 15 eV, onto the entrance opening 12 of the detector 6, a suitable lens diameter V, which is determined by the ratio a:D (a being the axial length of the first sector of the cylinder lens and D being the diameter of the cylindrical elements), is 0.79. The first cylinder section 19 is at ground potential while the second cylinder section as at −5 KV, the length l of the drift path and the diameter of the entrance of opening 12 being as described before, 1000 mm and 10 mm, respectively. FIG. 2 likewise shows the trajectories 13, 14 of ions which are projected onto the entrance opening 12 as well as trajectories 15, 16 of ions that are not.

Figure 3:
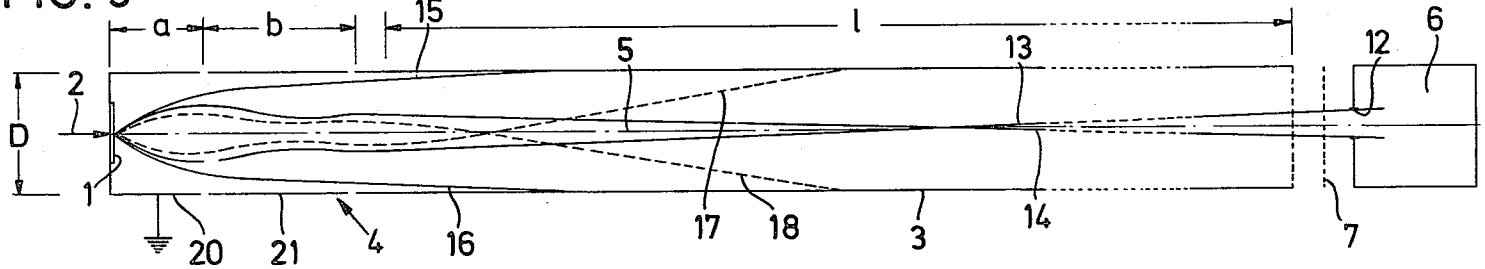
FIG. 3 is a diagrammatic sectional view of another embodiment of a mass spectrometer according to the present invention.

In the embodiment of FIG. 3, the lens system 4 is a three-section cylinder lens in which the effect of the time distortion in the acceleration path is even less than is the case in the embodiment of FIG. 2. The three sections are shown at 20, 21 and 3; here, too, the electrode which is furthest upstream of the input end of the drift path, namely, electrode 20, serves as the holding means for the test specimen. If (1) D is equal to b (b being the axial length of section 21), (2) a is equal to 0.79 D, (3) the first cylinder section 20 is at ground potential, (4) the cylinder section 21 is at −7 KV and (5) the third cylinder section 3 is at −3 KV, the ions are first accelerated by one potential and are then retarded to the drift potential of 3 KV. The lens system has the desired characteristic of a mass spectrometer according to the present invention. Besides showing the ion trajectories 13, 14, 15, 16, FIG. 3 likewise shows trajectories 17 and 18 which are followed by ions whose energy is below the energies of the desired energy interval. With the appropriate potentials being applied to the cylinder sections, these low energy ions are so strongly affected by the focussing potential that their trajectories cross far ahead of the entrance opening 12 of the detector 6 so that these ions will likewise be lost along the wall of the drift path.

Figure 4:
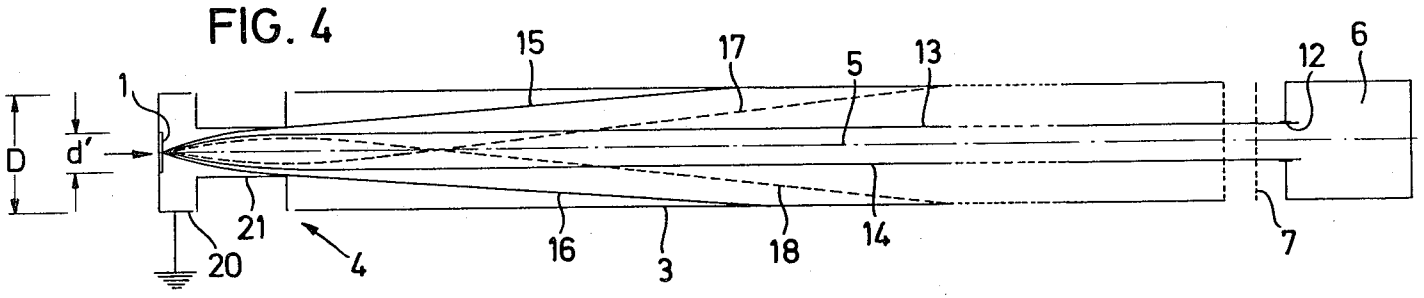
FIG. 4 is a diagrammatic sectional view of a third embodiment of a mass spectrometer according to the present invention.

The embodiment of FIG. 4 differs from that of FIG. 3 in that the second cylinder sector 21 has a diameter d′ which is smaller than the diameter D of the other two cylinder sections. In this way, the time distortion brought about by the finite acceleration path is reduced even further. In practice, D is preferably greater than 2d′.

Figure 5:
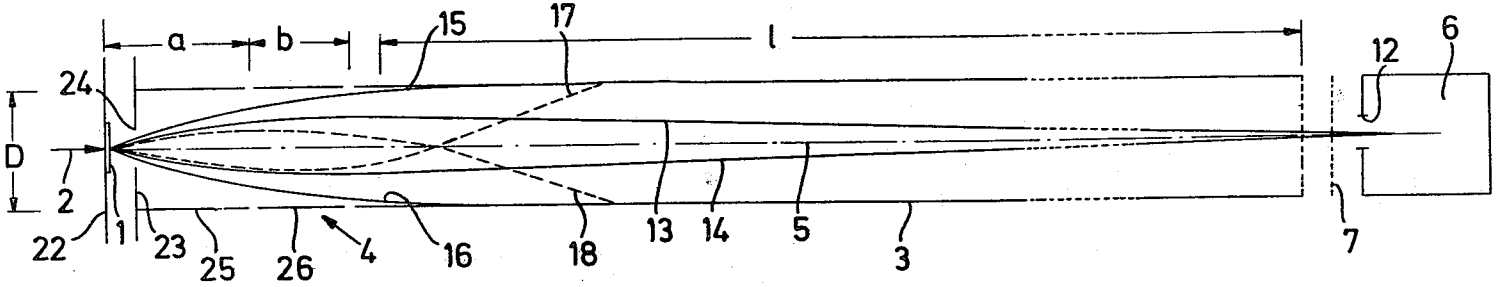
FIG. 5 is a diagrammatic sectional view of a fourth embodiment of a mass spectrometer according to the present invention.

FIG. 5 shows another modification of the embodiment of FIG. 3 and illustrates a mass spectrometer whose lens system comprises a support plate 22 which is furthest upstream of the input end of the shift path and which carries the test specimen 1, an aperture diaphragm 23 having an opening 24 which is as small as possible without impairing the ion flow, and the cylindrical sections 25, 26 and 3. Here, the effect of the time distortion caused by the acceleration path is reduced even further, as shown by the trajectories of the ions striking the entrance opening 12 of the detector 6. By way of example, the diameter ratios of the lens are selected as described in connection with FIG. 3, while the aperture diaphragm and the section 25 are at a potential of −5 KV, the section 26 is at a potential of −1 KV and the section 3 at a potential of −3 KV.

The data given in connection with the above embodiments relates to an energy interval having a band of 15 eV. Different parameters may be selected, depending on the desired resolving power of the mass spectrometer and on the type of energy distribution of the stimulated ions. Also, magnetic lens systems may be provided in place of the electrostatic lens systems.

It will be understood that the above description of the present invention is susceptible to various modifications, changes and adaptations, and the same are intended to be comprehended within the meaning and range of equivalents of the appended claims.

What is claimed is:

1. A transit time mass spectrometer for analyzing ions produced by pulsed laser radiation and having different energies, comprising, in combination:

(a) means forming a drift path to be traversed by the ions in a predetermined direction, said drift path comprising a cyclindrical section having an input end and an output end;

(b) an ion detector arranged downstream of said output end and having an entrance opening;

(c) an electrostatic lens system for focussing as well as for accelerating the ions and including a plurality of electrodes, including three which are in the form of cylindrical sections, one of said three electrodes being constituted by said cylindrical section serving as said drift path and the other two of said sections being arranged upstream of said input end, said lens system being a means for focussing onto said entrance opening only those ions which have a predetermined energy interval lying in the region of the maximum energy distribution;

(d) means for holding an ion-emitting test specimen which is to be subjected to the laser radiation, said holding means being constituted by that electrode of said lens system which is the furthest upstream of the input end of the drift path; and (e) means forming an aperture diaphragm arranged between an ion-emitting test specimen which is held by said holding means and the next downstream cylindrical section, said diaphragm having an aperture which is as small as possible without impairing the ion flow, said diaphragm being at the same potential as said next downstream cylindrical section.

2. A mass spectrometer as defined in claim 1, wherein said lens system is configured to produce said focussing.

3. A mass spectrometer as defined in claim 1, wherein said lens system is connected to a voltage supply which causes said lens system to produce said focussing.

4. A mass spectrometer as defined in claim 1, further comprising a retarding grid arranged between said output end and said ion detector.

5. A mass spectrometer as defined in claim 1, wherein the electrode constituting said holding means is a fourth electrode.

6. A mass spectrometer as defined in claim 5, wherein said fourth electrode is in the form of a support plate.

* * * * *

UNITED STATES PATENT AND TRADEMARK OFFICE

CERTIFICATE OF CORRECTION

PATENT NO. : 4,295,046

DATED : October 13, 1981

INVENTOR(S) : Karl Grüter et al

It is certified that error appears in the above—identified patent and that said Letters Patent is hereby corrected as shown below:

On the title page, Item [75] should read:
--Reiner Wechsung of Cologne, Federal Republic of Germany--.

In Column 3, Line 47 change "and l being" to --and ℓ being--.

Signed and Sealed this

Fourth Day of May 1982

[SEAL]

Attest:

GERALD J. MOSSINGHOFF

Attesting Officer

Commissioner of Patents and Trademarks